United States Patent [19]

Nilsson et al.

[11] 4,192,490

[45] Mar. 11, 1980

[54] LANCE FOR INJECTING POWDERY MATERIAL INTO MOLTEN METAL

[75] Inventors: Per A. Nilsson; Gunnar B. Harryson; Leif T. Larsson; Karl J. Poderschan, all of Fagersta; Pekka Ritakallio; Theo Lehner, both of Luleå, all of Sweden

[73] Assignee: Stiftelsen for Metallurgisk Forskning, Lulea, Sweden

[21] Appl. No.: 945,821

[22] Filed: Sep. 26, 1978

[30] Foreign Application Priority Data

Oct. 4, 1977 [SE] Sweden ..... 7711065

[51] Int. Cl.[2] ..... C21C 5/48

[52] U.S. Cl. ..... 266/225

[58] Field of Search ..... 75/60; 266/225

[56] References Cited

U.S. PATENT DOCUMENTS

| | | | |
|---|---|---|---|
| 2,991,173 | 7/1961 | Trentini | 266/225 |
| 3,063,828 | 11/1962 | Booth | 266/225 |
| 3,488,044 | 1/1970 | Shepherd | 75/60 |

*Primary Examiner*—P. D. Rosenberg

*Attorney, Agent, or Firm*—Larson, Taylor and Hinds

[57] ABSTRACT

A lance for injecting a powdery material together with a carrier gas in metal melts such as liquid steel. The lance consists of a tubular body with an inner pipe bore having an inlet end and an outlet end for transport of powder through the tube. The lance has at least one outlet duct arranged adjacent the lower end for conducting powder from the pipe bore to the outside of the lance, said duct forming an angle of less than 90° with the axis of the lance and being directed slopingly outwards/downwards from the bore towards the lance tip. The outlet duct or ducts are arranged in a nozzle contiguous to the tip of the lance, said tip being formed by a ceramic body intended for abutment against the bottom or wall in a ladle. In the outlet end of the pipe bore there is arranged a distributing means with a conical end adjacent the inlet openings of the outlet duct or ducts, for uniform distribution of the powdery material thereto.

7 Claims, 3 Drawing Figures

LANCE FOR INJECTING POWDERY MATERIAL INTO MOLTEN METAL

The present invention relates to a lance for injecting powdery material together with a carrier gas into molten metal, especially liquid steel.

Injecting or introducing a powdery material together with a carrier gas directly into molten metal can either take place through nozzles in the bottom or wall of the ladle or through a lance dipped into the melt. The purpose of the injection can vary, e.g. alloying different elements, dioxidation, separation of non-metallic inclusions, modification of inclusions, desulphuring, refining, fine grain treatment and temperature adjustment.

In the injection of a steel melt by means of a lance, the steel is tapped into a casting ladle which is taken to the injecting plant, where the lance is mounted in a raisable and lowerable structure, which most often is also rotatable. The powder feed is started by means of a pneumatic conveyor system, whereby the lance is lowered down into the melt. Injection continues until a predetermined amount of powder has been fed in, or until the right temperature has been obtained, or for a predetermined time. The lance is thereafter raised and the ladle is transported further, possibly after a certain retention time, to casting.

A conventional injection lance for steel melts has its outlet in the tip of the lance. However, such a construction causes problems when the charge weights for which the lance is used are small, e.g. of the order of magnitude 40 tons and less. The small charge weight means that the bath depth will be small and the injected material has too short a time to react, and it then reaches the surface of the bath partially unconsumed. If, for example, SiCa is injected into the steel melt, Ca is vaporized on introduction into the melt and must have time to react with the melt while rising before it reaches the surface. Experience shows, however, that this does not take place, and the Ca reacts with oxygen from the air above the bath. This leads to a poor yield, which must be compensated for by increased amounts of SiCa, in turn resulting in that the treatment time will be longer and temperature losses greater. With low charge weights, splash problems also occur, caused by the violent agitation, which results in that steel slops over the edge of the ladle and that the unconsumed Ca reaching the surface of the bath entrains steel and slag drops with it, which splash out. There are furthermore problems with wear of the casting ladle and lance as well as stopper bar. Wear on the lance and stopper bar presumably depends on erosion in the slag line, and the violent agitation of the bath surface results in that the brick protection of the ladle is worn. As a result of poor stability, the lance and supporting structure shift, although attempts to improve this can be made by lowering the feed rate, but this leads to the outflow rate at the lance outlet opening becoming so small that steel enters the opening, resulting in its constriction. The above-mentioned disadvantages result in that the life of the injection lance is often limited to a single execution of the process.

The object of the present invention is to provide an injection lance, especially a lance for injecting powdery material into metal melts with low charge weight, for which the problems mentioned above are avoided without the feed rate for the powdery material needing to be decreased and thereby the treatment time increased.

The new and distinguishing features for a lance according to the invention are apparent from the patent claims.

Since the outlet or outlets for the injected powder lie at a distance up on a lance according to the invention, and not at the tip of the lance as is conventional, the lance tip can be supported against the bottom of the ladle. This means that the lance is subjected to smaller mechanical stresses and its mounting is more stable. Alternatively, its suspending structure can be made simpler and cheaper. The powder outlet or outlets always lie at the same definite distance from the ladle bottom, which means that one can always work with optimum conditions with regard to reaction time. The risk of bottom failure in the ladle disappears almost entirely, and even otherwise the liner durability of the ladle will be better. Since the lance has its tip firmly against the ladle bottom, the lance liner is also subjected to less wear, e.g. in the shape of corrosion at the slag line, which is usual with a conventional lance. Accordingly, while a conventional lance has only been able to be used once with the same lining, a lance according to the invention has still not shown any signs of wear after using three times.

When the lance according to the invention is provided with a plurality of outlets which are downwardly inclined from the axis of the lance, there is provided the possibility to a larger feed of powder due to the increased contact surface with the metal melt. Furthermore, the consumption of additives will be less wastefull and the treatment time can be reduced. Since the powder with this design of the lance can be distributed further out from the lance, less wear is obtained on the lance itself, as well as a quieter surface of the bath in the ladle and better admixture of the powder into the melt.

The smaller wear on the lance and stopper bar signifies that the treatment times for the injection treatment are not limited by this wear.

A lance according to the invention is described in detail in the following while referring to the attached drawings, on which an embodiment of the lance is schematically illustrated as an example.

Figure 1:
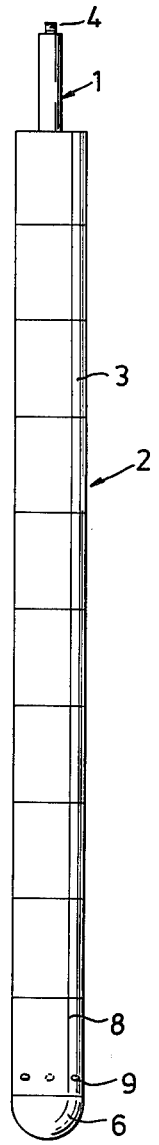
FIG. 1 is a side view of a lance according to the invention.
Figure 2:
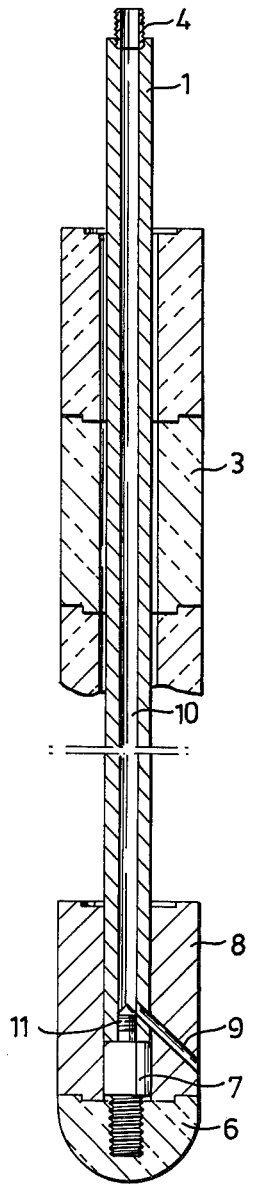
FIG. 2 shows a longitudinal section of the lance according to FIG. 1 to a larger scale and excluding a central portion of the lance.

The lance shown on the drawings consists of an inner steel pipe 1 with a tubular liner 2 of pipe brick 3 arranged outside it. At its upper end the steel pipe 1 has a coupling union 4 for connecting a gas and powder line 5 according to FIG. 3. At its lower end the lance has a ceramic hemisphere 6, which is screwed onto a threaded plug 7, in turn welded to the lower end of the steel pipe 1. Between the hemisphere 6 and the lowest of the pipe bricks 3 there is a distribution nozzle 8 with three downwardly inclined exit ducts 9 connecting the bore 10 inside the pipe 1 with the outside of the lance, said ducts having a peripheral pitch of 120°. These ducts are preferably lined with copper pipe. The ducts 9 start from the bore 10 adjacent to a distributing screw 11 with a conical top, the screw being mounted on the plug 7.

Figure 3:
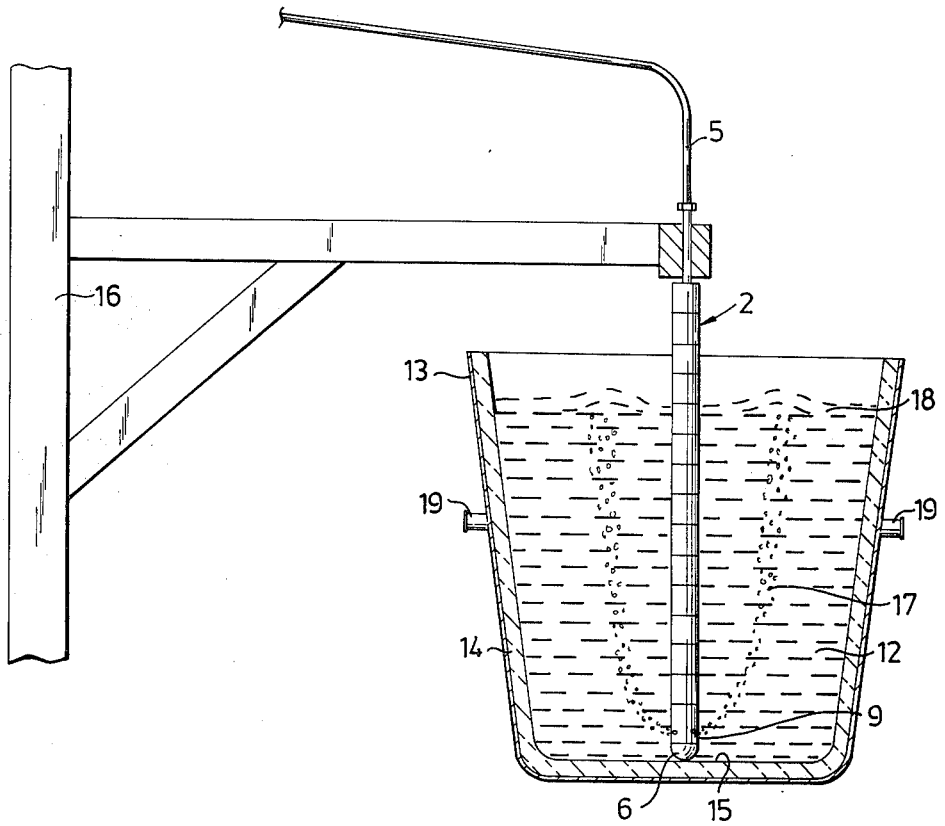
FIG. 3 shows a lance according to the invention suspended in its frame and dipped into a ladle with a metal melt.

In FIG. 3 there is shown how the lance 2 is dipped into a metal melt 12 in a ladle with a steel casing 13 and a brick lining 14. The tip of the lance thereby abuts with the ceramic hemisphere 6 against the ladle bottom 15. Upwardly, the lance is suspended in a frame 16 and the powdery material is fed together with carrier gas via the previously mentioned line 5 to the bore 10 of the steel pipe, and further through this bore down to the outlet ducts 9 and into the metal melt, where the powder and the carrier gas 17 begin to rise towards the slag surface 18. The powder hereby is able to react better with the melt than in known lances of this kind, due in the first place to it being distributed in three different directions in the melt and in the second place it being distributed further away from the lance by the downwardly inclined ducts. This downward inclination of the ducts is about 45° to the axis of the lance in the shown example, but other suitable values between 0 and 90° and preferably between 30 and 60° can be selected. The number of ducts can naturally be other than the three shown in the example. One, two, four or even more ducts can be used, and they are preferably distributed at an equal pitch around the periphery of the lance. When treatment is terminated, the lance 2 is lifted out of the ladle with the aid of the frame 16, and the ladle transported away by it being lifted in both trunnions 19.

The lance has hereinbefore been described especially with reference to steel melts. However, it can also be used for other metallic melts, e.g. those of cast iron, copper, lead alloys etc.

We claim as our invention:

1. An elongate lance for injecting a powdery material carried by a carrier gas into metal melts in a ladle, comprising:

a tubular body with an inner pipe bore having an inlet and an outlet end;

a rounded tip formed of ceramic material located at the outlet end of said tubular body; and at least one outlet duct having an inlet opening adjacent the outlet end of the pipe bore and an outlet opening located above said tip, said duct forming an angle of less than 90° with the longitudinal axis of the lance and being directed slopingly outwards and downwards from the pipe bore towards said tip;

such that the lance is lowered into the ladle until said tip abuts against the bottom of the ladle and the powdery material is carried by the carrier gas through the pipe bore and said duct, exiting into the metal melt above said tip.

2. A lance as claimed in claim 1, characterized in that the outlet duct or ducts form an angle greater than 15° but less than 75° to the longitudinal axis of the lance.

3. A lance as claimed in claim 1 or 2, characterized in that the outlet duct or ducts are arranged in a nozzle contiguous to the tip of the lance.

4. A lance as claimed in claim 1 or 2 characterized in that the outlet duct or ducts are arranged in a nozzle which is integrally formed with said tip.

5. A lance as claimed in claim 1 or 2 characterized by a plurality of outlet ducts which are arranged with uniform distribution around the periphery of the lance.

6. A lance as claimed in claim 5, characterized in that there are three outlet ducts with a mutual spacing of 120°.

7. A lance as claimed in any one of claims 1 or 2, characterized in that in the outlet end of the pipe bore there is arranged a distributing means with a conical end adjacent in inlet openings of the outlet duct or ducts, for uniform distribution of the powdery material thereto.

* * * * *